US008136337B2

(12) United States Patent
Jackson

(10) Patent No.: US 8,136,337 B2
(45) Date of Patent: Mar. 20, 2012

(54) WIRE TWISTING DEVICE

(76) Inventor: Albert Jackson, St. Joseph, MO (US)

( * ) Notice: Subject to any disclaimer, the term of this patent is extended or adjusted under 35 U.S.C. 154(b) by 9 days.

(21) Appl. No.: 12/646,053

(22) Filed: Dec. 23, 2009

(65) Prior Publication Data

US 2011/0146222 A1 Jun. 23, 2011

(51) Int. Cl.
*D01H 7/02* (2006.01)

(52) U.S. Cl. ..... 57/59; 57/66; 57/1 UN

(58) Field of Classification Search ..... 57/1 UN, 57/59, 60, 64, 66; 140/118, 119, 120, 122, 140/149
See application file for complete search history.

(56) References Cited

U.S. PATENT DOCUMENTS

| | | | | |
|---|---|---|---|---|
| 353,535 | A * | 11/1886 | Bunch | 140/118 |
| 450,671 | A | 4/1891 | Hoffman | |
| 1,181,297 | A | 5/1916 | Fenlason | |
| 1,367,632 | A | 2/1921 | Smith | |
| 1,453,447 | A | 5/1923 | Davidson | |
| 2,260,443 | A | 10/1941 | Downing | |
| 2,297,174 | A | 9/1942 | Tabb | |
| 2,688,449 | A | 9/1954 | Haagensen | |
| 3,026,915 | A | 3/1962 | Jones | |
| 3,163,187 | A | 12/1964 | Macintosh | |
| 3,211,187 | A | 10/1965 | Kurt | |
| 3,311,139 | A | 3/1967 | Allen | |
| 3,333,609 | A | 8/1967 | Alexander | |
| 3,338,273 | A | 8/1967 | Kalning | |
| 3,353,343 | A | 11/1967 | Nubuo | |
| 3,554,243 | A | 1/1971 | DeRose | |
| 3,593,759 | A | 7/1971 | Wooge | |
| 3,696,599 | A | 10/1972 | Palmer | |
| 3,716,080 | A | 2/1973 | Scaddan | |
| 4,362,192 | A | 12/1982 | Furlong | |
| 4,393,905 | A | 7/1983 | Perrien | |
| 4,413,660 | A | 11/1983 | Conrad | |
| 4,838,726 | A | 6/1989 | Lucas Huerta | |
| 4,880,038 | A | 11/1989 | Meinershagen | |
| 4,941,515 | A | 7/1990 | Vrenning | |
| 4,947,902 | A | 8/1990 | Lehmann | |
| 5,004,020 | A | 4/1991 | Meinershagen | |
| 5,217,049 | A | 6/1993 | Forsyth | |
| 5,275,383 | A | 1/1994 | Wick | |
| 5,279,336 | A | 1/1994 | Kusakari | |
| 5,361,809 | A | 11/1994 | Chan | |
| 5,363,525 | A | 11/1994 | Andreasen | |
| 5,458,159 | A | 10/1995 | Kilmer | |
| 5,613,530 | A | 3/1997 | Kincel | |
| 5,735,508 | A | 4/1998 | Lancour | |
| 5,842,506 | A | 12/1998 | Peters | |
| 5,853,033 | A | 12/1998 | Kavanagh | |

(Continued)

FOREIGN PATENT DOCUMENTS

| | | |
|---|---|---|
| CN | 1089997 | 7/1994 |

(Continued)

*Primary Examiner* — Shaun R Hurley
(74) *Attorney, Agent, or Firm* — Brannon Robinson Sowers Hughel & Doss PC

(57) ABSTRACT

A wire twisting device and a method for use is provided. One embodiment includes a plate having a wire engaging face, a tool engaging face, and a plurality or wire ports extending therethrough. The wires to be twisted are inserted through individual, appropriately sized wire ports which hold the wires in place relative to one another. A shaft operably connected to the tool engaging face is then rotated thereby rotating the plate and twisting the wires.

13 Claims, 6 Drawing Sheets

U.S. PATENT DOCUMENTS

| | | | | |
|---|---|---|---|---|
| 5,887,631 | A | 3/1999 | Eaton | |
| 5,947,166 | A | 9/1999 | Doyle | |
| 6,041,833 | A | 3/2000 | Suric | |
| 6,668,871 | B1 | 12/2003 | Bundy | |
| 6,752,810 | B1 | 6/2004 | Gao | |
| 2007/0283559 | A1* | 12/2007 | Jackson | 29/748 |
| 2008/0053558 | A1* | 3/2008 | Rodriguez et al. | 140/118 |
| 2009/0308483 | A1* | 12/2009 | James | 140/120 |

FOREIGN PATENT DOCUMENTS

| | | |
|---|---|---|
| DE | 4019584 | 1/1991 |
| GB | 330660 | 6/1930 |
| GB | 2326970 | 1/1999 |
| JP | 4075733 | 3/1992 |
| WO | WO-9329816 | 2/1993 |
| WO | WO-2004083559 | 9/2004 |

* cited by examiner

WIRE TWISTING DEVICE

CROSS-REFERENCE TO RELATED APPLICATIONS

This application claims priority to co-pending patent application Ser. No. 11/423,279, filed Jun. 6, 2006.

TECHNICAL FIELD

The present novel technology relates generally to electrical wires, and more particularly to devices for simultaneously twisting together two or more electrical wires.

BACKGROUND

Electrical cables used in industrial, commercial, and residential applications generally consist of a plurality of wires twisted together to form a single cable. Examples of such cables include non-metallic sheath (NM) such as Romex® (a registered trademark of the Southwire Company, a Delaware corporation doing business at One Southwire Drive, Carrollton, Ga., 30119), armored cable, and other types of twisted and/or braided cable. Cable is traditionally run in a building or other job site to a junction box, breaker panel, electrical apparatus, or other suitable electrical connection. It is often necessary to untwist the individual wires that make up the cable in order to make the appropriate electrical connections.

Frequently more than one wire is required to be connected to a single electrical contact point. One way to accomplish connecting two or more wires to a single connection is to twist the wires together. For example, multiple ground wires are typically twisted together to connect to a single ground at a junction box. Traditionally, twisting is accomplished manually, such as by gripping the wires with lineman's pliers and rotating the pliers until the wires are sufficiently twisted. However, manual wire twisting with pliers is time consuming, labor intensive, and can contribute to carpal tunnel syndrome. Additionally, it is difficult to generate sufficient torque to simultaneously twist more than two wires together, especially where the wires are of a large gauge. Alternative methods of twisting wires using mechanical devices typically involve rotating devices which use clips, clamps, or other securing methods to hold the wires in place while twisting. Such devices are time consuming to use as individual wires must be secured to the devices prior to twisting, and must then be released from the devices after twisting. Other such devices secure wires into slots, which do not snugly and securely engage the wires, which are prone to disengagement upon jiggling or impact of the device, or by double looping the wires through a pair of apertures formed into rotatable discs, which require the excess wire to have to either be manually disengaged (a time-consuming procedure that obviates most of the time saved by the twisting device) or cut away from the twisting device (again requiring time and effort and wasting wire).

What is needed is a device that securely engages the wires to be twisted, facilitates the efficient simultaneous twisting of multiple strands of electrical wire, and allows for the quick and easy disengagement of the wires therefrom once twisted. The claimed novel technology addresses these needs.

SUMMARY

The following is not in any way to limit, define or otherwise establish the scope of legal protection. In general terms, the claimed technology relates to twisting electrical wires. In one embodiment, a wire twisting device is provided that comprises a plate having a wire engaging face, a tool engaging face, and a plurality of wire ports extending therethrough. Each wire to be twisted is inserted through an appropriately sized wire port. A shaft extending from the tool engaging face is then rotated either manually or using a suitable mechanical device such as an electric drill, thereby rotating the plate and twisting the wires.

In another embodiment, a wire twisting device is provided that includes a plurality or wire ports appropriately sized to accept wires of various gauges.

One object is to provide and improved wire twisting device and method for using the same.

Further objects, embodiments, forms, benefits, aspects, features and advantages of the claimed technology may be obtained from the description, drawings, and claims provided herein.

DESCRIPTION OF THE PREFERRED EMBODIMENTS

Figure 1:
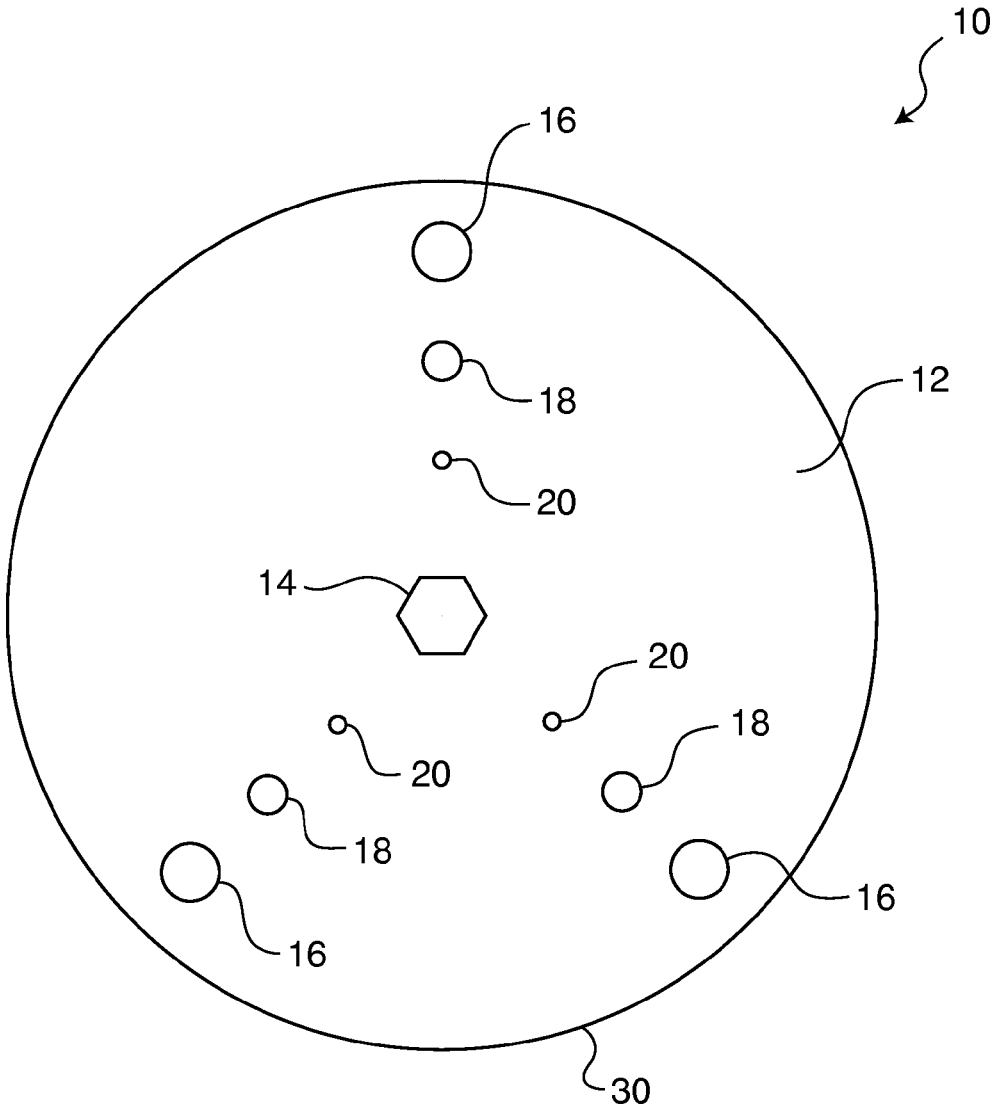
FIG. 1 is a plan view of one example of a wire twisting device.

For the purposes of promoting an understanding of the principles of the claimed technology and presenting its currently understood best mode of operation, reference will now be made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would normally occur to one skilled in the art to which the claimed technology relates.

Figure 2:
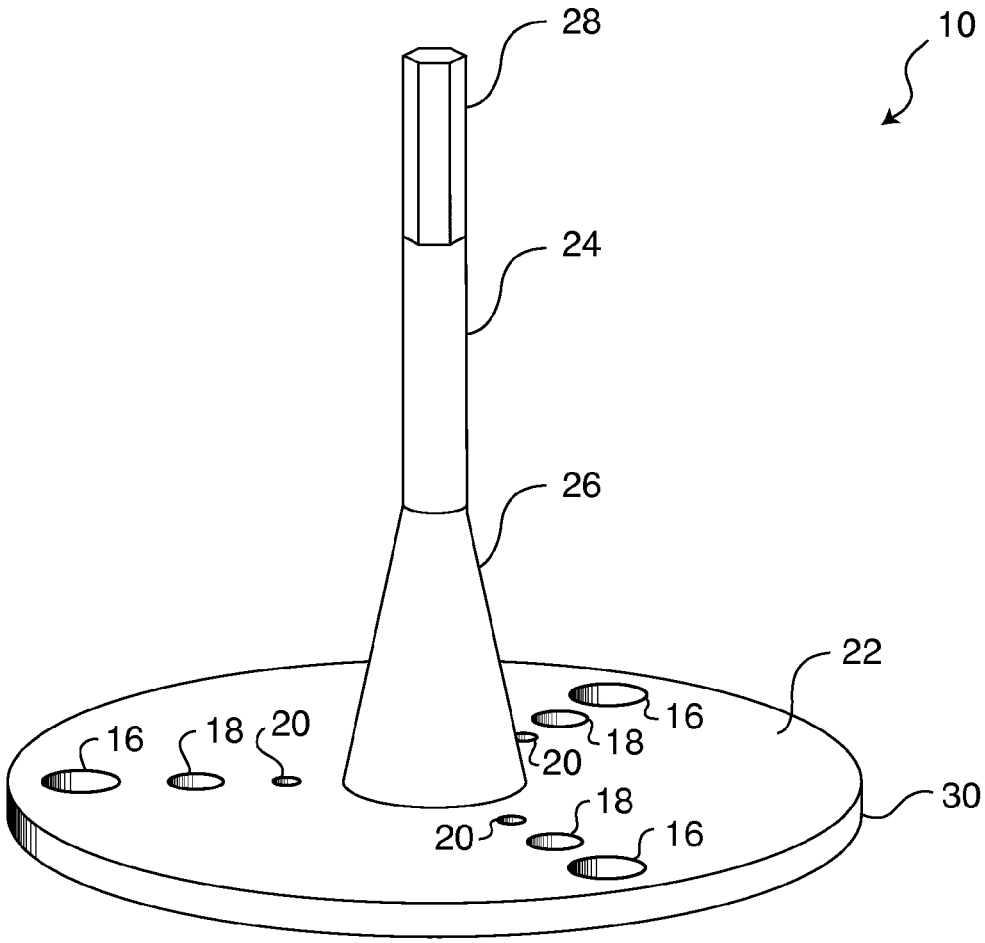
FIG. 2 is a side perspective view of the wire twisting device of FIG. 1.

One example of a wire twisting device 10 is shown in FIGS. 1-2. In this particular example, wire twisting device 10 comprises a plate 30 having a wire engaging face 12 and a tool engaging face 22. Plate 30 is shown as a disk for illustrative purposes only, while in other examples the plate may be ovular, square, triangular, polygonal, conical, or any other suitable shape as desired. Plate 30 can be made from any number of suitable materials including metal, high density plastic, composites, epoxy, polyurethane, ceramic, wood, and the like.

Plate 30 further includes a plurality of wire ports 16, 18, 20 which extend through plate 30 from wire engaging face 12 to tool engaging face 22. Wire ports 16, 18 and 20 are typically respectively sized to snugly engage wires of three different diameters or gauges. In this particular example, plate 30 includes three wire ports 16 sized and configured so as to substantially snugly allow passage of 10-gauge wire therethrough. The 10-gauge wire ports 16 are disposed on plate 30 so as to be substantially equidistant from each other. That is, approximately 120 degrees separate each 10-gauge wire port radially. Plate 30 further includes three wire ports 18 sized and configured so as to substantially snugly allow passage of 12-gauge wire therethrough. The 12-gauge wire ports 18 are disposed on plate 30 so as to be substantially equidistant from each other. That is, approximately 120 degrees separate each 12-gauge wire port radially. Plate 30 still further includes three wire ports 20 sized and configured so as to substantially snugly allow passage of 14-gauge wire therethrough. The 14-gauge wire ports 20 are disposed on plate 30 so as to be substantially equidistant from each other. That is, approximately 120 degrees separate each 14-gauge wire port radially.

Continuing with the present example, wire twisting device 10 further includes a shaft 24 operably connected to the tool engaging face 22 of plate 30 such that rotation of shaft 24 causes rotation of plate 30. Shaft 24 is joined to plate 30 using a bolt 14 in this particular example. In other examples, shaft 24 is joined to plate 30 using screws, rivets, a threaded shaft, welds, glue, epoxy, or other suitable joining means. Alternatively, shaft 24 and plate 30 form a single, unitary structure.

Shaft 24 includes a plate engaging portion 26 and a tool engaging portion 28. Plate engaging portion 26 is shown with a conical shape to provide increased strength to the joint between shaft 24 and plate 30 and increased stability to plate 30 when wire twisting device 10 is rotated. The conical shape of plate engaging portion 26 is shown for illustrative purposes only and other plate engaging portions having other shapes and configurations are also contemplated. Tool engaging portion 28 is shown as a hex-shaped member configured and sized to engage with the chuck of an electric drill or other suitable apparatus to facilitate mechanical rotation of shaft 24.

Figure 3:
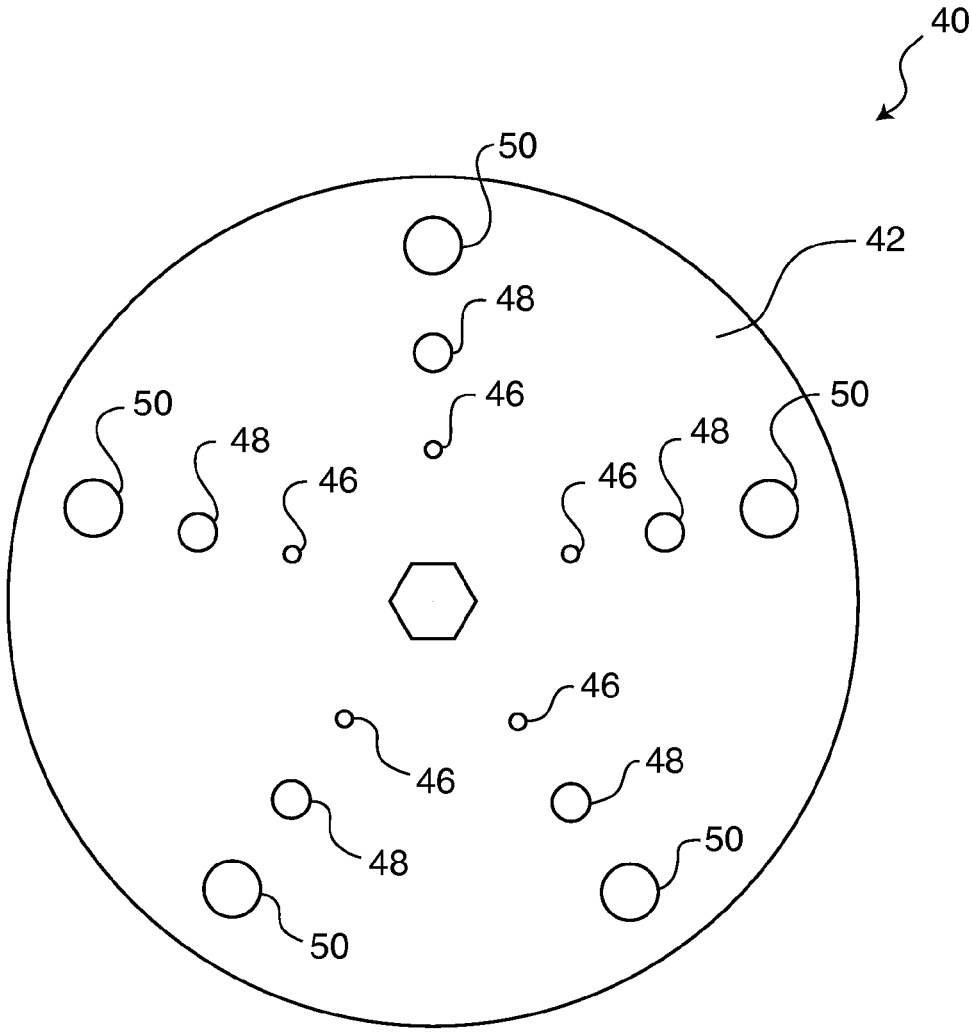
FIG. 3 is a plan view of another example of a wire twisting device.

In another example, as shown in FIG. 3, a wire twisting device 40 comprises a plate having a wire engaging face 42 including a plurality of wire ports 46, 48, 50 extending therethrough. In this particular example, wire twisting device 40 includes five wire ports 50 sized and configured so as to snugly allow passage of 10-gauge wire therethrough. The 10-gauge wire ports 50 are disposed on wire twisting device 40 so as to be substantially equidistant from each other. That is, approximately 72 degrees separate each 10-gauge wire port radially. Wire twisting device 40 further includes five wire ports 48 sized and configured so as to snugly allow passage of 12-gauge wire therethrough. The 12-gauge wire ports 48 are disposed on wire twisting device 40 so as to be substantially equidistant from each other. That is, approximately 72 degrees separate each 12-gauge wire port radially. Wire twisting device 40 still further includes five wire ports 46 sized and configured so as to snugly allow passage of 14-gauge wire therethrough. The 14-gauge wire ports 46 are disposed on wire twisting device 40 so as to be substantially equidistant from each other. That is, approximately 72 degrees separate each 14-gauge wire port radially.

Figure 4:
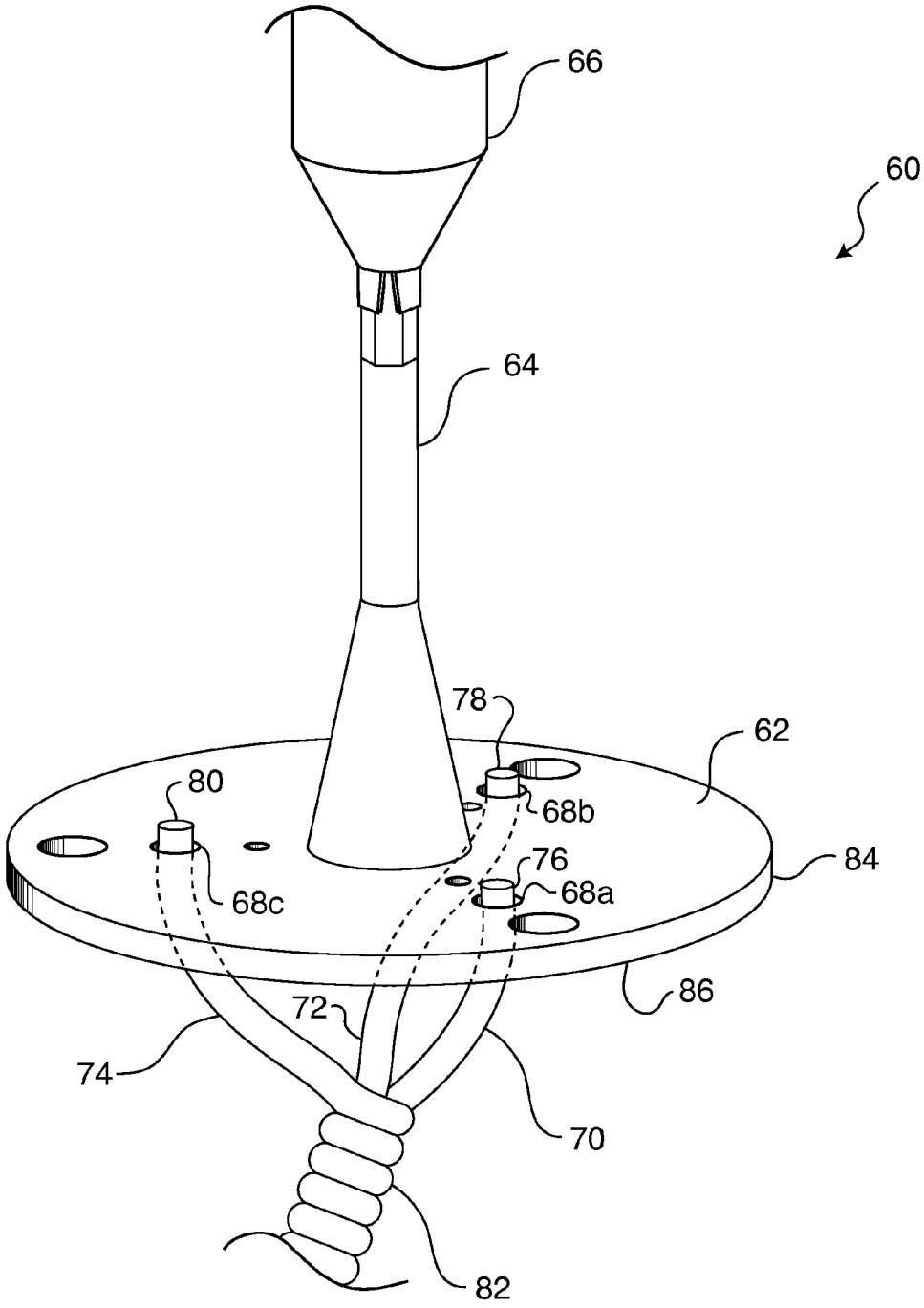
FIG. 4 is a side perspective view of still another example of a wire twisting device.

FIG. 4 shows yet another example of a wire twisting device 60. In this example, wire twisting device 60 comprises a plate 84 having a wire engaging face 86, a tool engaging face 62, and a plurality or wire ports therethrough 68*a*, 68*b*, 68*c*. Wire twisting device 60 further includes a shaft 64 operably mounted to plate 84 and operably engaged to the chuck 66 of an electric drill such that when the drill is operated, shaft 64 rotates thereby rotating plate 84.

Continuing with the present example, wire twisting device 60 is engaged with three individual wires 70, 72, 74 by insertion of the wires through wire ports 68*a*, 68*b*, 68*c*, respectively, so that a length of wire 76, 78, 80 extends through plate 84. Wire ports 68*a*, 68*b*, 68*c* are sized and configured to allow wires 70, 72, 74 to snugly fit therethrough such that when plate 84 is rotated, wires 70, 72, 74 do not inadvertently withdraw from wire ports 68*a*, 68*b*, 68*c* and disengage plate 84 prematurely. Rotation of plate 84 imparts rotational motion on wires 70, 72, 74 thereby twisting the individual wires about one another to form a twisted braid 82.

Figure 5:
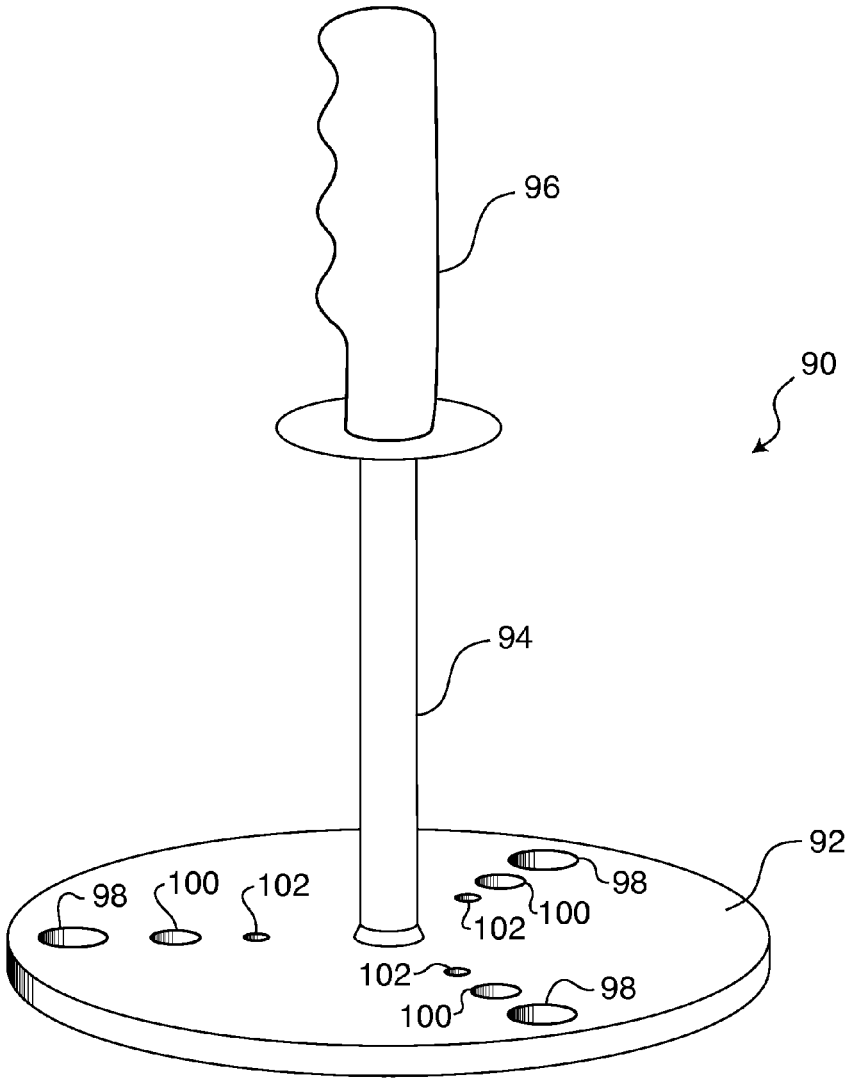
FIG. 5 is a side perspective view of yet another example of a wire twisting device.

FIG. 5 shows still another example of a wire twisting device 90. In this example, wire twisting device 90 comprises a plate 92 operably connected to a shaft 94. Plate 92 includes a plurality of appropriately sized wire ports 98, 100, 102. Shaft 94 further includes a handle portion 96 such that when handle 96 is manually rotated, shaft 94 is rotated thereby rotating plate 92.

Figure 6:
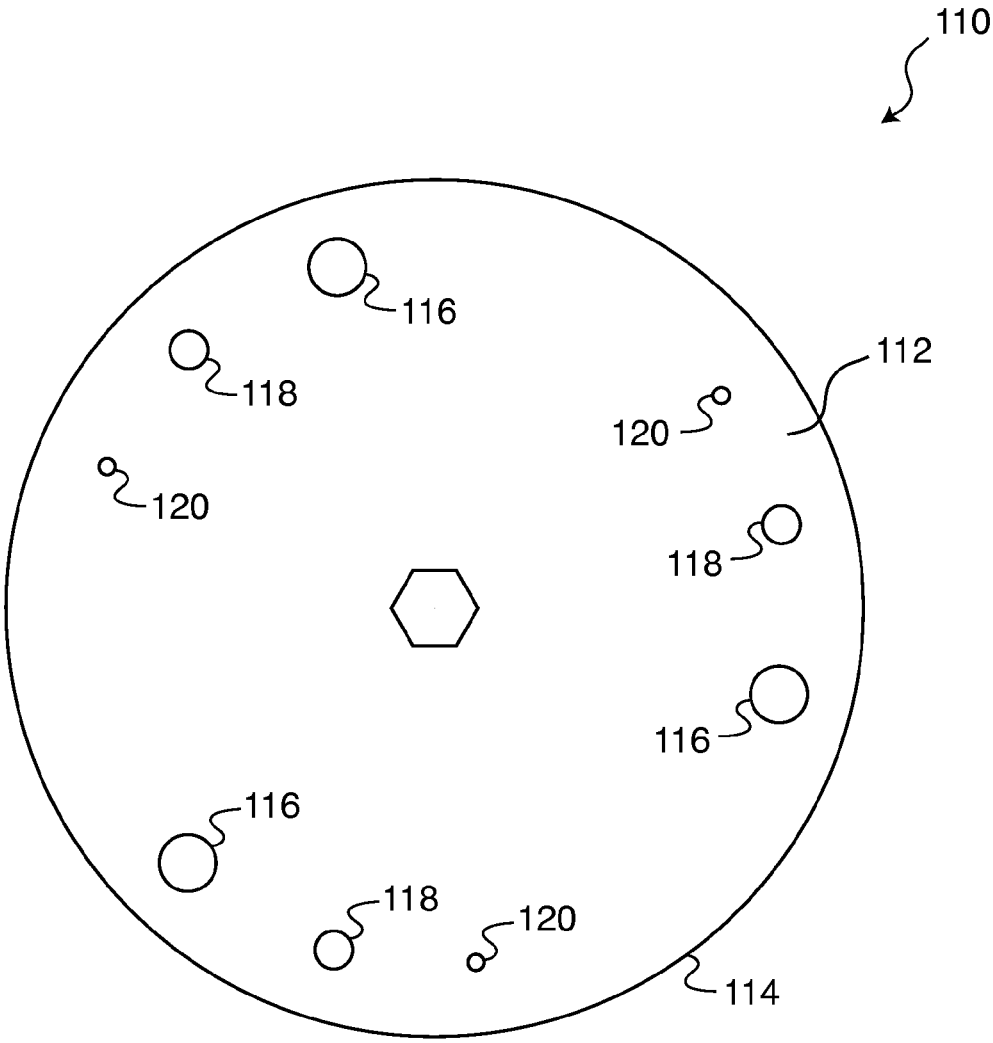
FIG. 6 is a plan view of a further example of a wire twisting device.

FIG. 6 shows a further example of a wire twisting device 110. In this example, wire twisting device 110 comprises a shaft (not shown) operably engaged to a plate 114 having a wire engaging face 112. A plurality of appropriately sized wire engaging ports 116, 118, 120 are disposed about wire engaging face 112.

An example of twisting wires together using one example of a wire twisting device will now be described. In this example, three 12-gauge copper wires are provided to be twisted together using a twisting device 10, such as that shown in FIGS. 1-2. Three 12-gauge copper wires are used for illustrative purposes only and twisting devices 10 can be used to simultaneously twist greater or fewer wires or wires of different and/or non-uniform gauges and wires of different compositions such as 10-gauge, 14-gauge, aluminum wires, and the like.

A wire twisting device 10 such as that shown in FIGS. 1-2 is provided having wire ports sized and configured to accept 14-gauge wires, 12-gauge wires, and 10-gauge wires. In this example, the 12-gauge wires to be twisted are inserted through the 12-gauge wire ports 16, 18, 20 on the plate 30 of the wire twisting device 10. The ports 16, 18, 20 are typically circular apertures. The 12-gauge ports are sized and configured so that a 12-gauge wire fits snugly therethrough and the wire remains engaged with the plate 30 without additional clamps, clips, bending, or other securing methods. Typically, only a few millimeters of wire are extended through the ports 16, 18, 20. More typically, the wire portions extending through the ports are not substantially bent or otherwise deformed to facilitate engagement to plate 24; the snug engagement of the wires through the appropriately-sized ports 16, 18, 20 is sufficient to secure the wires to plate 24.

Continuing with the present example, rotational motion is imparted to the wire twisting device 10 by rotation of the shaft 24. In one example, the shaft 24 is manually rotated, such as by twisting a handle. In another example, the shaft 24 is mechanically rotated using an electric drill. In still other examples, the shaft 24 is rotated using other suitable mechanical means for imparting rotational motion. Typically, engagement of the wires with apertures 16, 18, 20 and/or the shaft 24 with a mechanical rotation device (such as a drill) imparts a rapid series of linear and/or rotational motions of varying directions onto the already-engaged wires (i.e., the engaged wires are jiggled when additional wires are engaged and/or when the device is engaged to a drill); once engaged with the apertures 16, 18, 20, the wires are snugly held against clockwise and counterclockwise rotational motions as well as motions in the plane perpendicular to that defined by the plate 30. Once the wires have been twisted together to the desired degree, the individual wires are withdrawn from the wire ports 16, 18, 20 of the plate 30, leaving a twisted braid of three wires having substantially straight end portions.

The preceding description has detailed wire twisting devices 10 configured to twist 10, 12, and 14 gauge wires. This description is for illustrative purposes only and wire twisting devices configured to twist wires of other gauges are also contemplated. In other examples, it is possible to twist wires of non-uniform gauges together such as two 10-gauge wires and one 12-gauge wire. In still other examples, it is possible to twist two, four, or more wires together simultaneously.

While the claimed technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the claimed technology are desired to be protected.

What is claimed is:

1. A wire twisting device comprising:

a plate having a wire engaging face, a tool engaging face, and nine wire ports extending therethrough;

a shaft operably connected to the plate such that rotation of the shaft is imparted to the plate;

wherein each respective wire port defines a substantially circular aperture; and wherein the nine wire ports include three ports sized and configured to substantially snugly engage 14-gauge wire, three ports sized and configured to substantially snugly engage 12-gauge wire, and three ports sized and configured to substantially snugly engage 10-gauge wire.

2. The wire twisting device of claim 1, wherein the three wire ports sized and configured to substantially snugly engage 14-gauge wire are arranged so as to be substantially equidistant from one another;

wherein the three wire ports sized and configured to substantially snugly engage 12-gauge wire are arranged so as to be substantially equidistant from one another; and wherein the three wire ports sized and configured to substantially snugly engage 10-gauge wire are arranged so as to be substantially equidistant from one another.

3. The wire twisting device of claim 1, wherein the shaft is configured to operably connect to the chuck of an electric drill.

4. The wire twisting device of claim 1, wherein the shaft further comprises a handle adapted to facilitate manual rotation of the shaft.

5. A wire twisting device comprising:

a plate having a wire engaging face, a tool engaging face, and at least nine substantially circular wire ports extending therethrough;

a shaft operably connected to the plate such that rotation of the shaft is imparted to the plate; and wherein the at least nine wire ports include equal numbers of ports sized and configured to snugly engage 14-gauge wire, ports sized and configured to snugly engage 12-gauge wire, and ports sized and configured to snugly engage 10-gauge wire.

6. The wire twisting device of claim 5, wherein the plate includes fifteen wire ports including five ports sized and configured to snugly engage 14-gauge wire, five ports sized and configured to snugly engage 12-gauge wire, and five ports sized and configured to snugly engage 10-gauge wire.

7. The wire twisting device of claim 6, wherein the five wire ports sized and configured to snugly engage 14-gauge wire are arranged so as to be substantially equidistant from one another;

wherein the five wire ports sized and configured to snugly engage 12-gauge wire are arranged so as to be substantially equidistant from one another; and wherein the five wire ports sized and configured to snugly engage 10-gauge wire are arranged so as to be substantially equidistant from one another.

8. The wire twisting device of claim 5, wherein the shaft is configured to operably connect to the chuck of an electric drill.

9. The wire twisting device of claim 5, wherein the shaft further comprises a handle adapted to facilitate manual rotation of the shaft.

10. A method for twisting electrical wire, comprising:

providing a wire twisting device having a plate including at least as many wire ports extending therethrough as wires to be twisted, wherein each respective wire port defines a substantially circular aperture, and wherein the wire ports include equal numbers of ports sized and configured to snugly engage 14-gauge wire, wire ports sized and configured to snugly engage 12-gauge wire, and wire ports sized and configured to snugly engage 10-gauge wire;

snugly engaging each wire with the wire twisting device by inserting the respective wire through a respective appropriately sized wire port;

rotating the wire twisting device;

twisting the respective wires together to form a braided wire segment; and disengaging the braided wire segment from the wire twisting device to expose substantially straight end portions.

11. The method of claim 10, wherein the wire twisting device is operably connected to the chuck of an electrical drill; and wherein rotating the wire twisting device is accomplished by rotation of the drill chuck.

12. The method of claim 10, wherein the wire twisting device is operably connected to a handle; and wherein rotating the wire twisting device is accomplished by manual rotation of the handle.

13. The method of claim 10, wherein the three wire ports sized and configured to snugly engage 14-gauge wire are arranged so as to be substantially equidistant from one another;

wherein the three wire ports sized and configured to snugly engage 12-gauge wire are arranged so as to be substantially equidistant from one another; and wherein the three wire ports sized and configured to snugly engage 10-gauge wire are arranged so as to be substantially equidistant from one another.

* * * * *